US008443549B2

(12) United States Patent
Salvietti et al.

(10) Patent No.: US 8,443,549 B2
(45) Date of Patent: May 21, 2013

(54) SLIDING DOOR WITH LARGE OPENING

(75) Inventors: Michael Arthur Salvietti, Northfield, CT (US); Thomas M. Kowalczyk, Unionville, CT (US); Dwight Edward Reed, Springfield, TN (US); Daniel R. Seymour, Plainville, CT (US); Michael A. Zabbo, East Windsor, CT (US); Vito A. Spinelli, Shelton, CT (US); Ronald Bohigian, Southington, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 467 days.

(21) Appl. No.: 12/719,540

(22) Filed: Mar. 8, 2010

(65) Prior Publication Data

US 2011/0214350 A1 Sep. 8, 2011

(51) Int. Cl.

| | |
|---|---|
| ***E05F 15/14*** | (2006.01) |
| ***E05D 15/22*** | (2006.01) |
| ***E05D 15/48*** | (2006.01) |
| ***E06B 3/70*** | (2006.01) |

(52) U.S. Cl.
USPC ..... 49/141; 49/118; 49/410

(58) Field of Classification Search ..... 49/409–410, 49/141, 61–63, 116, 118, 120, 121, 123, 49/125; 160/194, 195, 203
See application file for complete search history.

(56) References Cited

U.S. PATENT DOCUMENTS

| | | | | |
|---|---|---|---|---|
| 704,887 | A | 7/1902 | Low | |
| 2,373,023 | A * | 4/1945 | Goodwin | 49/102 |
| 3,354,581 | A * | 11/1967 | Kessner et al. | 49/141 |
| 3,464,159 | A | 9/1969 | Hewitt et al. | |
| 3,466,805 | A | 9/1969 | Muessel | |
| 3,491,483 | A | 1/1970 | Miller | |
| 4,078,333 | A * | 3/1978 | Lussier | 49/141 |
| 4,305,227 | A | 12/1981 | Georgelin | |
| 4,534,395 | A * | 8/1985 | Carroll | 160/199 |
| 4,619,074 | A | 10/1986 | Leung et al. | |
| 5,242,005 | A * | 9/1993 | Borgardt | 160/118 |
| 5,392,834 | A * | 2/1995 | Borgardt | 160/118 |
| 5,417,272 | A | 5/1995 | Marlowe et al. | |
| 5,486,026 | A * | 1/1996 | Borgardt | 292/71 |
| 5,762,123 | A * | 6/1998 | Kuyama et al. | 160/195 |
| 5,832,980 | A | 11/1998 | Cianciolo | |
| 5,893,181 | A | 4/1999 | Moncaster | |
| 5,908,064 | A | 6/1999 | Bruce | |
| 6,058,665 | A * | 5/2000 | Halvorson et al. | 52/205 |
| 6,061,961 | A | 5/2000 | Rupe | |
| 6,082,053 | A * | 7/2000 | Bischof et al. | 52/64 |

(Continued)

*Primary Examiner* — Katherine Mitchell
*Assistant Examiner* — Justin Rephann
(74) *Attorney, Agent, or Firm* — Richard J. Veltman; John D. DelPonti

(57) ABSTRACT

A door assembly includes a track, a track header, a fixed door panel, at least two sliding door panels, a pivot mechanism, and a lock arrangement. The sliding door panels are slidably movable on the track between (1) a closed position wherein the sliding door panels are extended across the track, and (2) an open position wherein the sliding door panels are constructed and arranged to be in a compact, overlapping relationship with each other and the fixed door panel. The pivot mechanism is constructed and arranged to enable pivotal movement of the track with fixed door panel and the two sliding door panels mounted thereon about a pivot axis from a normal configuration to a breakaway configuration. The lock arrangement is constructed and arranged to releasably lock the track with respect to the track header to prevent pivotal movement of the track away from the normal configuration.

20 Claims, 12 Drawing Sheets

U.S. PATENT DOCUMENTS

| | | | | |
|---|---|---|---|---|
| 6,161,334 | A | 12/2000 | Goodin | |
| 6,170,195 | B1 | 1/2001 | Lim | |
| 6,276,092 | B1 * | 8/2001 | Neo | 49/183 |
| 6,422,287 | B1 | 7/2002 | Wilke | |
| 6,526,695 | B1 | 3/2003 | Nguyen | |
| 6,618,994 | B1 * | 9/2003 | Nussbaum | 49/180 |
| 6,973,753 | B2 * | 12/2005 | Liebscher | 49/308 |
| 7,296,608 | B2 | 11/2007 | Weishar et al. | |
| 7,451,802 | B2 | 11/2008 | Cianciolo et al. | |
| 7,458,410 | B1 * | 12/2008 | Bronner | 160/197 |
| 2004/0049984 | A1 * | 3/2004 | Pfaff | 49/116 |
| 2006/0150512 | A1 * | 7/2006 | Heithe et al. | 49/141 |
| 2006/0197357 | A1 | 9/2006 | Catania | |
| 2007/0068080 | A1 | 3/2007 | Vigdorovich et al. | |
| 2007/0119548 | A1 | 5/2007 | Anderson | |

* cited by examiner

SLIDING DOOR WITH LARGE OPENING

BACKGROUND OF THE INVENTION

Field of the Invention

The present invention relates to a sliding door assembly that includes a track, sliding door panels mounted thereon that are slidable between open and closed positions, and wherein the sliding door panels are constructed and arranged to pivot from a normal configuration to a breakaway configuration.

Door assemblies with sliding door panels are installed in many environments (e.g., in commercial buildings), where sliding door panels are configured to automatically slide open and close in order to provide easy access to premises and avoid congestion in high traffic environments.

Sliding door assemblies generally include a frame assembly with at least one fixed or non-sliding door panel mounted thereto and one, two or more sliding door panels that move in a generally rectilinear manner between opened and closed positions. The sliding door panels typically slide along their own individual track. The non-sliding or fixed door panels are typically positioned such that they are on opposing lateral sides of the sliding door panels when the sliding door panels are closed. During normal operation, a power-operated door operator moves the sliding door panel(s) between the opened and closed positions thereof.

Oftentimes, either the sliding door panels, the non-sliding door panels, or both are provided with the capability to open outwardly in a swinging manner under an application of a force (e.g., manual force) to allow persons to pass through the door assembly during certain conditions (e.g., if the door operator is unable to open the sliding door panel(s)). This capability, referred to in the art as "breakout" or "breakaway," is often required by state or local building codes as a measure for facilitating exit from buildings during power outages, or other such situations wherein the door operator may be unable to cause the door panels to slide open. This breakaway feature permits the door panels to be pivotally swung open about a pivot axis. The breakaway feature is also provided, in some cases, to improve access to the building for bulky objects, as it provides wide opening and also prevents the door panels from automatically sliding back to the closed position.

Each of the individual door panels (sliding door panels and fixed/non-sliding door panel) are typically configured to pivot to the breakaway position separately about their own pivot axis (i.e., there are individual pivots axes for each door panel on each side of the door assembly). Further, the pivoting action of the door assembly is generally permitted only when the sliding door panels are in their fully closed position. In many instances, however, it may be desirable to limit the use of breakaway features. In one example, such desire may derive from a desire to reduce or deter theft of goods through such doors (e.g., at night when the powers to the doors may be discontinued).

The present invention provides several improvements over the prior art.

SUMMARY OF THE INVENTION

One aspect of the present invention provides a door assembly that includes a track, a track header, a fixed door panel, at least two sliding door panels, a pivot mechanism, and a lock arrangement. The track header is constructed and arranged to be mounted with respect to an opening formed through a wall to which the door assembly is installed. The fixed door panel is constructed and arranged to be fixed relative to the track, and the at least two sliding door panels are constructed and arranged to be slidably movable on the track. The sliding door panels are constructed and arranged to be slidably movable on the track between (1) a closed position wherein the sliding door panels are extended across the track, and (2) an open position wherein the sliding door panels are constructed and arranged to be in a compact, overlapping relationship with each other and the fixed door panel. The pivot mechanism is constructed and arranged to enable pivotal movement of the track with fixed door panel and the two sliding door panels mounted thereon about a pivot axis from (1) a normal configuration wherein the track is positioned such that the door panels will cover the opening when in the closed position, to (2) a breakaway configuration wherein the track is pivoted away from the normal configuration. The lock arrangement is constructed and arranged to releasably lock the track with respect to the track header to prevent pivotal movement of the track away from the normal configuration. The lock arrangement is configured to enable the track to be unlocked with respect to the track header and enable the track with fixed door panel and the two sliding door panels mounted thereon to be pivoted away from the normal configuration to the breakaway configuration.

Another aspect of the present invention provides a method for controlling a pivotal movement of a door assembly that includes maintaining a track with a fixed door panel and at least two sliding door panels mounted thereon in a pivotally locked condition with respect to a track header, and pivotably moving the track with the fixed door panel and the at least two sliding door panels mounted thereon away from the pivotally locked condition to the breakaway condition under an application of a force. The track, when in the pivotally locked condition, is positioned such that the sliding door panels are configured to extend across the track to cover an opening formed through a wall to which the door assembly is installed.

Yet another aspect of the present invention provides a door assembly that includes a track, a track header, a fixed door panel, at least two sliding door panels, and a pivot mechanism. The track header is constructed and arranged to be mounted with respect to an opening formed through a wall to which the door assembly is installed. The fixed door panel is constructed and arranged to be fixed relative to the track, and the at least two sliding door panels are constructed and arranged to be slidably movable on the track. The sliding door panels are constructed and arranged to be slidably movable on the track between (1) a closed position wherein the sliding door panels are extended across the track, and (2) an open position wherein the sliding door panels are constructed and arranged to be in a compact, overlapping relationship with each other and the fixed door panel. The pivot mechanism is constructed and arranged to enable pivotal movement of the track with fixed door panel and the two sliding door panels mounted thereon about a pivot axis from (1) a normal configuration wherein the track is positioned such that the door panels will cover the opening when in the closed position, to (2) a breakaway configuration wherein the track is pivoted away from the normal configuration. The track with fixed door panel and the two sliding door panels mounted thereon is pivoted away from the normal configuration when the sliding door panels are in the closed position, the open position, or an intermediate position therebetween.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated can be considered are drawn to scale. It is to be expressly understood, however, that the drawings are for the purpose of illustration and description only and are not intended as a definition of the limits of the invention. It shall also be appreciated that the features of one embodiment disclosed herein can be used in other embodiments disclosed herein. As used in the specification and in the claims, the singular form of "a" "an", and "the" include plural referents unless the context clearly dictates otherwise.

DETAILED DESCRIPTION OF THE INVENTION

Figure 5:
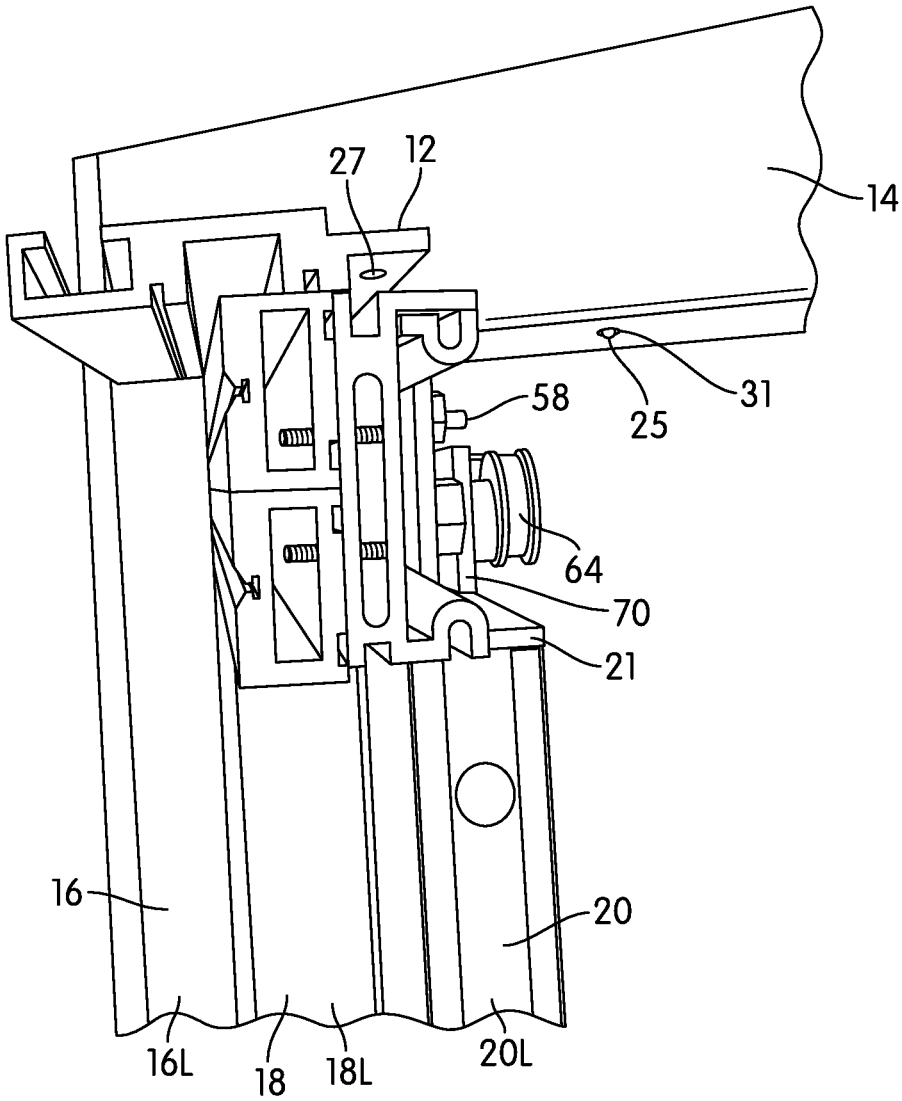
FIG. 5 is a perspective view of the door assembly illustrating a lock arrangement of the door assembly in accordance with an embodiment of the present invention.
Figure 6:
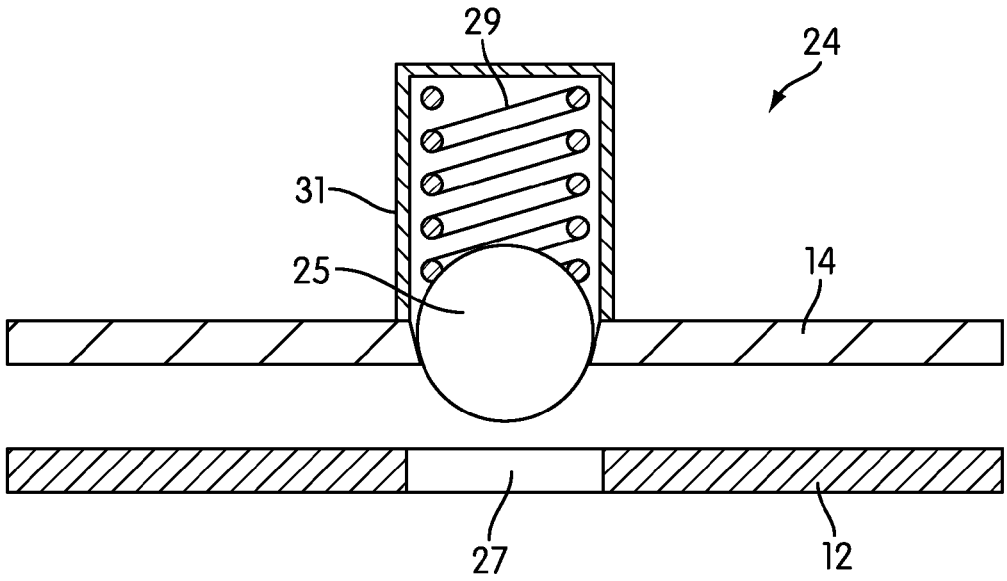
FIG. 6 shows the lock arrangement of the door assembly in accordance with an embodiment of the present invention.
Figure 10:
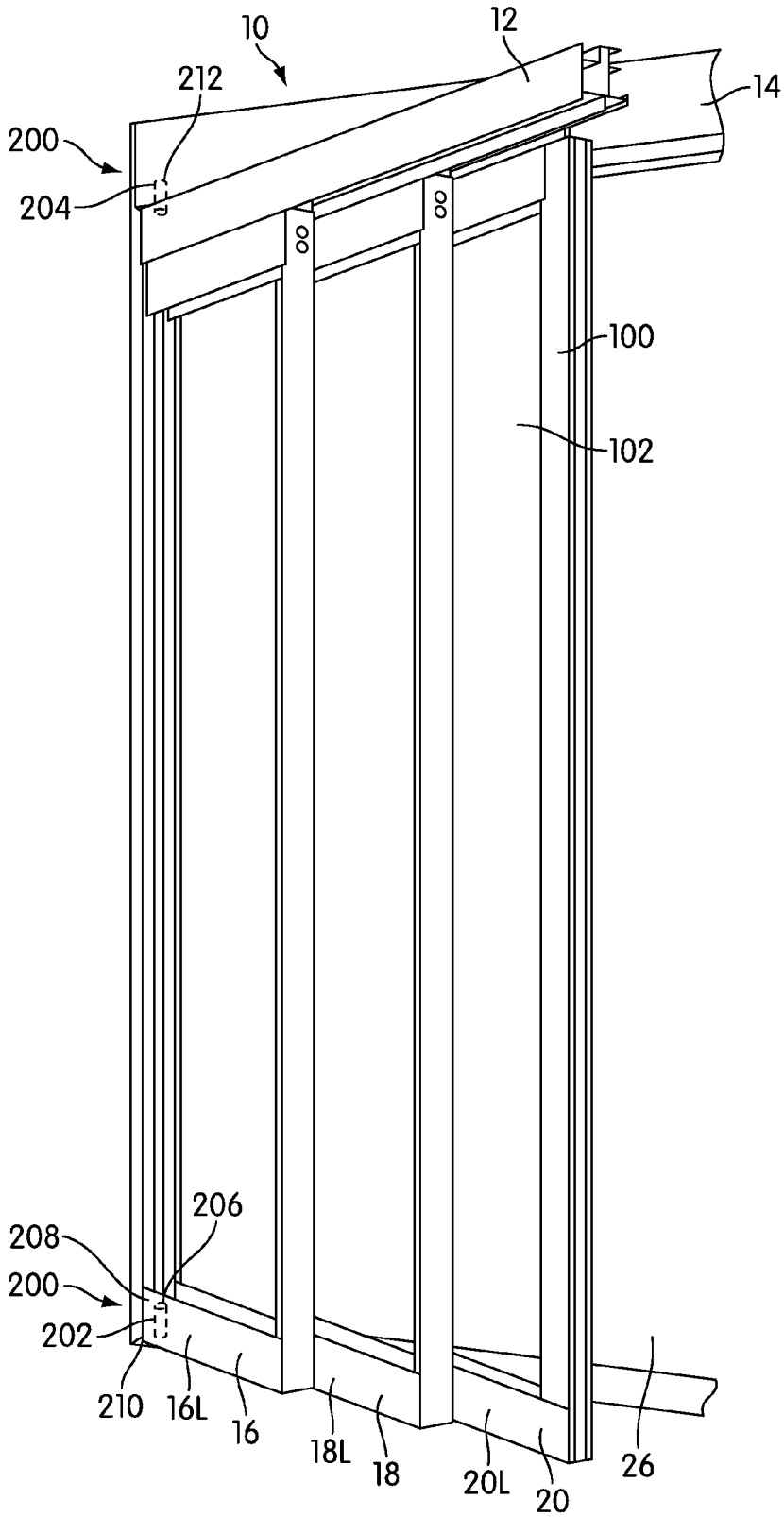
FIG. 10 shows a pivot mechanism of the door assembly in accordance with an embodiment of the present invention.

FIGS. 1A, 1B, 5 and 6 show a door assembly 10 that includes a track 12, a track header 14, a fixed door panel 16, at least two sliding door panels 18 and 20, a pivot mechanism 200 (as shown in FIG. 10), and a lock arrangement 24 (as shown in FIGS. 5 and 6). The track header 14 is constructed and arranged to be mounted with respect to an opening 26 formed through a wall 30 to which the door assembly 10 is installed. The fixed door panel 16 is constructed and arranged to be fixed relative to the track 12, and the at least two sliding door panels 18 and 20 are constructed and arranged to be slidably movable on the track 12. The sliding door panels 18 and 20 are constructed and arranged to be slidably movable on the track 12 between (1) a closed position wherein the sliding door panels 18 and 20 are extended across the track 12, and (2) an open position wherein the sliding door panels 18 and 20 are constructed and arranged to be in a compact, overlapping relationship with each other and the fixed door panel. The pivot mechanism 200 (as shown in FIG. 10) is constructed and arranged to enable pivotal movement of the track 12 with fixed door panel 16 and the two sliding door panels 18 and 20 mounted thereon about a pivot axis from (1) a normal configuration wherein the track 12 is positioned such that the door panels 18 and 20 will cover the opening 26 when in the closed position, to (2) a breakaway configuration wherein the track 12 is pivoted away from the normal configuration. The lock arrangement 24 is constructed and arranged to releasably lock the track 12 with respect to the track header 14 to prevent pivotal movement of the track 12 away from the normal configuration. The lock arrangement 24 is configured to enable the track 12 to be unlocked pivotally with respect to the track header 14 and enable the track 12 with fixed door panel 16 and the two sliding door panels 18 and 20 mounted thereon to be pivoted away from the normal configuration to the breakaway configuration.

Figure 1A:
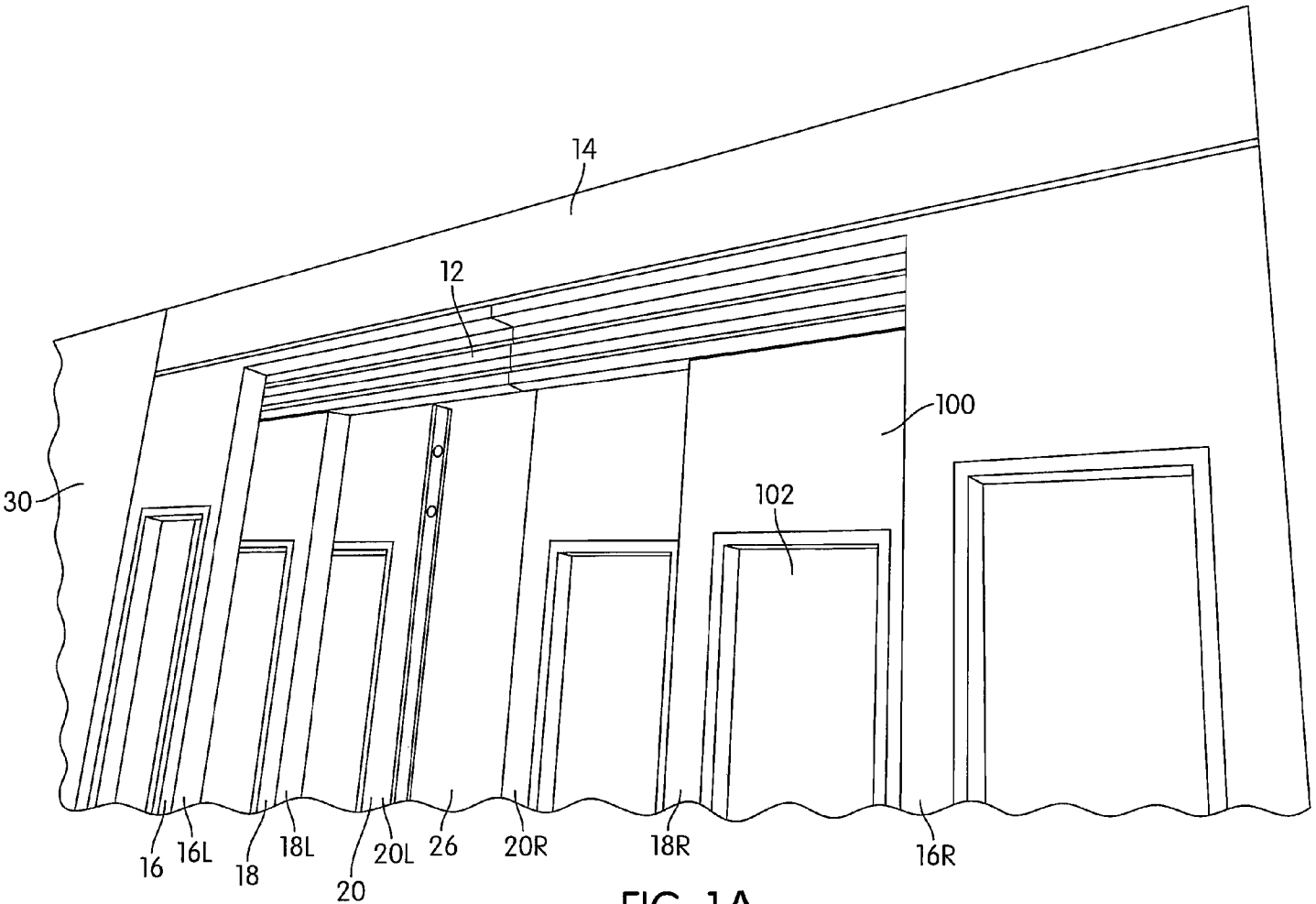
FIG. 1A is a front perspective view of a door assembly mounted across an opening of a wall in accordance with an embodiment of the present invention.
Figure 2:
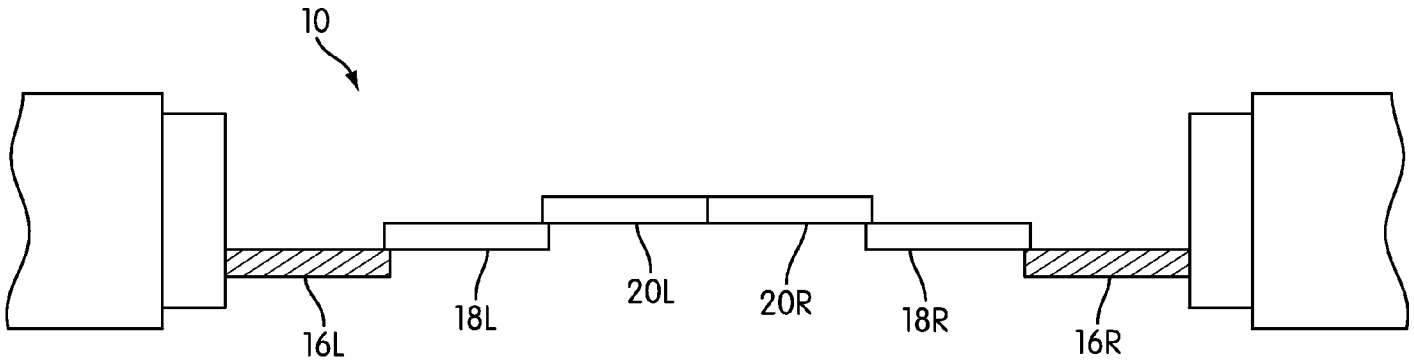
FIG. 2 is a top view of the door assembly mounted across the opening of the wall (with track and track header removed for clarity of illustration), when the sliding door panels 18 and 20 are in a closed position, in accordance with an embodiment of the present invention.
Figure 2A:
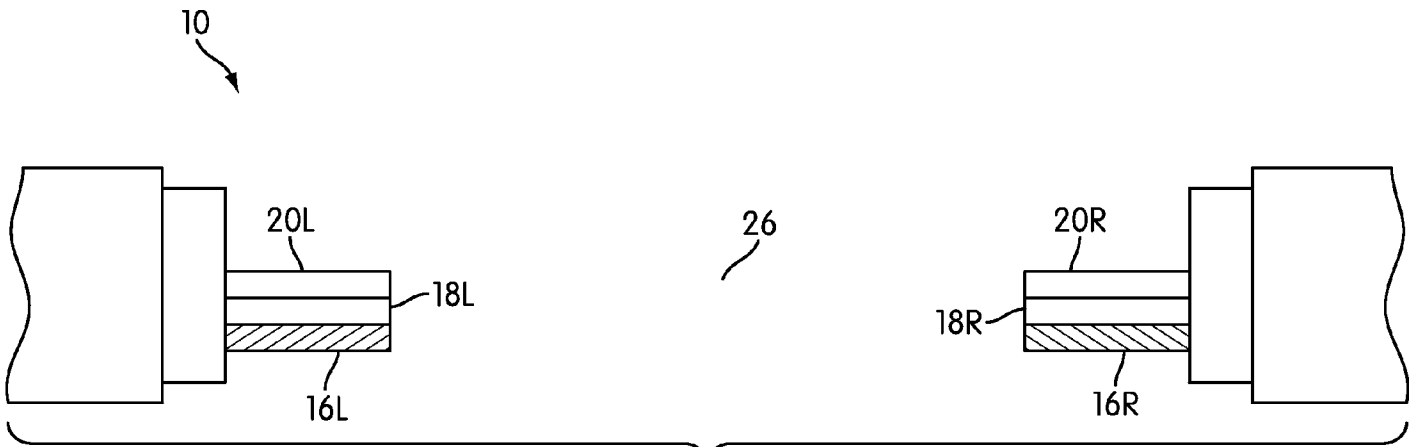
FIG. 2A is a top view of the door assembly mounted across the opening of the wall (with track and track header removed for clarity of illustration), when the sliding door panels 18 and 20 are in an open position, in accordance with an embodiment of the present invention.

In one embodiment, the track 12 with the fixed door panel 16 and the two sliding door panels 18 and 20 mounted thereon can be pivoted away from the normal configuration when the sliding door panels 18 and 20 are in the closed position (as shown in FIG. 2), in the open position (i.e., where the sliding door panels 18 and 20 are in a compact, overlapping relationship with each other as shown in FIG. 2A), or in an intermediate position (as shown in FIGS. 1A, and 7-10) therebetween (and even when the sliding doors are moving). It should be appreciated, however, that in another embodiment this pivoting may take place only when the sliding panels are in the normal, fully closed position and may be otherwise prevented from being pivoted to the breakaway configuration.

FIGS. 1A and 2 show a perspective view and a top view of the door assembly 10 mounted across the opening 26 of the wall 30. FIG. 1A shows the perspective view of the door assembly 10 mounted across the opening 26 of the wall 30, when the sliding door panels 18 and 20 are in the intermediate position, which is a position in between the closed position (as shown in FIG. 2) and the open position (i.e., where the sliding door panels 18 and 20 are in a compact, overlapping relationship with each other as shown in FIG. 2A) of the sliding door panels 18 and 20.

Figure 1B:
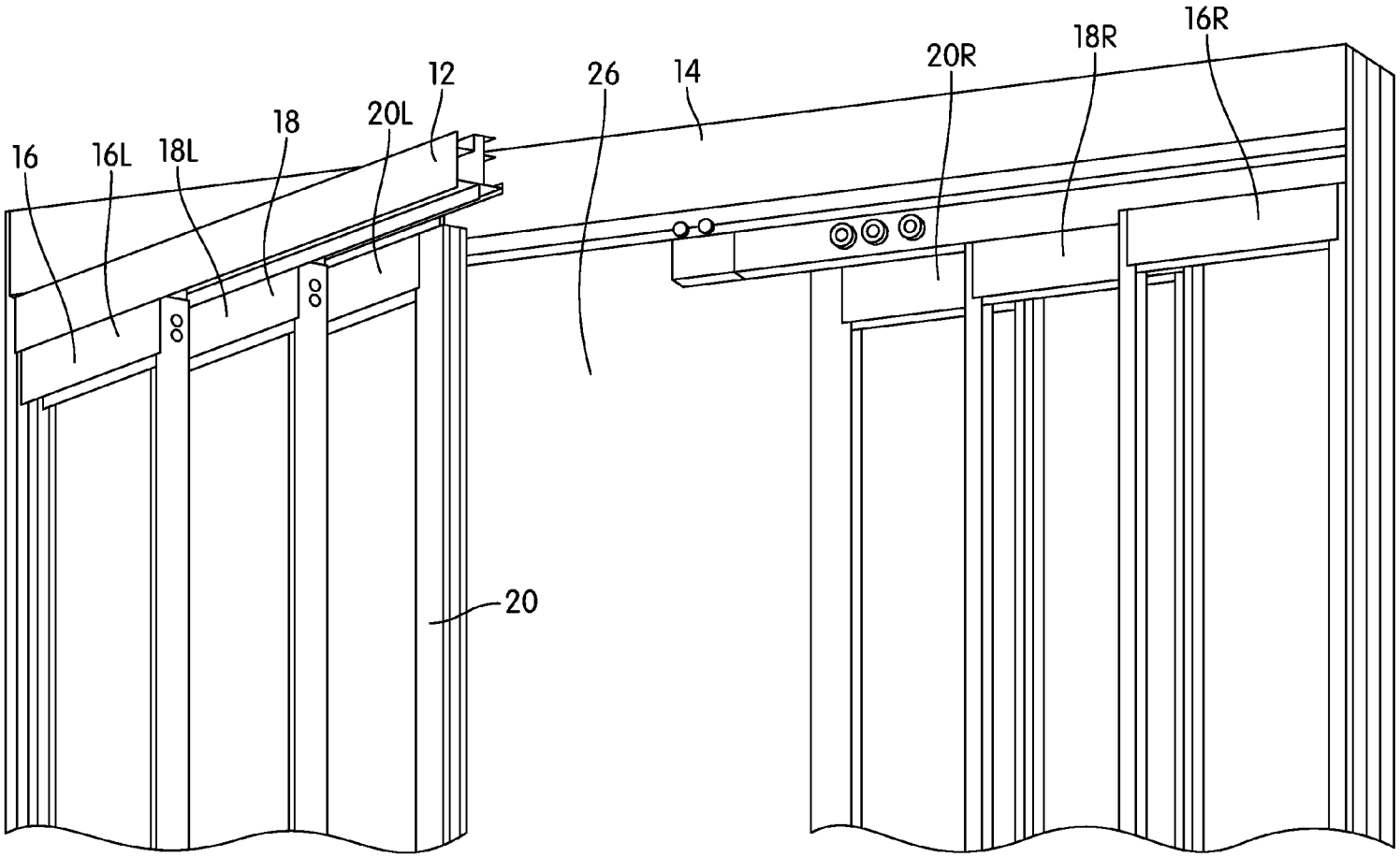
FIG. 1B is another front perspective view of the door assembly, wherein a track with fixed door panel and two sliding door panels mounted thereon is being pivoted away from a normal configuration when the sliding door panels are in an intermediate position, in accordance with an embodiment of the present invention.

FIG. 1B (in which for clarity of illustration certain features are removed) is another perspective view of the door assembly 10, wherein the track 12 with fixed door panel 16 and two sliding door panels 18 and 20 mounted thereon is being pivoted away from a normal configuration when the sliding door panels 18 and 20 are in an intermediate position.

FIG. 2A shows a top view of the door assembly 10 mounted across the opening 26 of the wall 30, when the sliding door panels 18 and 20 are in the open position. The sliding door panels 18 and 20, when in the open position, are constructed and arranged to permit access through the opening 26 when the door assembly 10 is installed.

FIG. 2 shows the top view of the door assembly 10 mounted across the opening 26 of the wall 30, when the sliding door panels 18 and 20 are in the closed position. Specifically, the sliding door panels 18 and 20 are shown occupying the opening 26 of the wall 30. The sliding door panels 18 and 20, when in the closed position, are constructed and arranged to prevent access through the opening 26 when the door assembly 10 is installed.

As shown in FIGS. 2 and 2A, the sliding door panels 18 and 20, and the fixed door panel 16 are slightly offset from each other, and the sliding door panels 18 and 20 are not in planar alignment with doorway. Also, in FIGS. 2 and 2A, track 12 and track header 14 are not shown for clarity of illustration.

In one embodiment, the door assembly 10 may include three door panels (i.e., one fixed panel 16 and two sliding door panels 18 and 20) mounted across the opening 26 of the wall 30. In another embodiment, as shown in the FIGS. 1A, 2, and 2A, the door assembly 10 may include three door panels located on each side (i.e., a left side and right side) of the door assembly 10. The fixed panels 16L, and the two sliding door panels 18L and 20L are located on the left side of the door assembly 10, and the fixed panels 16R, and the two sliding door panels 18R and 20R are located on the right side of the door assembly 10. The door assembly 10 shown, and the number of fixed and sliding panels, is intended to be exemplary and not limiting.

The fixed or the non-sliding door panels 16L and 16R may generally referred to herein as the first door panels and are disposed closest to a door jamb (not shown). In one embodiment, the fixed door panels 16L and 16R are disposed on opposing lateral sides of the sliding door panels 18L and 18R. The sliding door panels 20L and 20R may generally referred to as the third or the outermost door panels. The sliding door panels 18L and 18R may generally referred to as the second or the middle door panels are located between the fixed (or the non-sliding) door panels 16L and 16R, and the outermost door panels 20L and 20R respectively. Alternatively, the door panels 18L and 18R may generally referred to as the "slow" door panels, while the door panels 20L and 20R may generally referred to as the "fast" door panels. That is because, in an optional embodiment, the outer door panels 20L and 20R slidably move faster than the second door panels 18L and 18R when moving between the open and closed positions. This optional embodiment would be provided so that the slidable doors 18L, 18R, 20L, 20R arrive at the final position they assume when the door assembly is in the fully open or fully closed positions at generally the same time. For example, in one embodiment, in which the width of the door panels 18L, 18R, 20L, 20R are the same, the "fast" doors may move twice as fast as "slow" doors.

Generally, as shown in FIG. 1A, the door panels 16-20 include a door frame 100 that is constructed and arranged to surround a single or double glass panel 102. In one embodiment, the door frame 100 is generally constructed of a metal material (e.g., steel or aluminum) or a wood material. In one embodiment, the door frame 100 of the door panels 16, 18 and 20 may have hollow construction to permit the introduction and housing of electrical leads or connections.

The three-door panel construction (i.e., the fixed door panel 16, and two sliding door panels 18 and 20) of the door assembly 10 allows for a larger opening in comparison to a two-panel configuration, so as to permit wider access therethrough when the sliding door panels 18 and 20 are slid into the open position (i.e., where the sliding door panels 18 and 20 are in a compact, overlapping relationship with each other) because each door panel 16, 18 and 20 of the three-door panel door assembly 10 has a smaller width than the door panels of a door assembly with a two-door panel structure (i.e., having a fixed door panel and a sliding door panel to cover the same sized opening).

As noted previously, the sliding door panels 18 and 20 are sliding from the closed position (as shown in FIG. 2) to the open position (i.e., where the sliding door panels 18 and 20 are in a compact, overlapping relationship with each other), the outermost sliding door 20 moves twice as fast as the middle sliding door 18 so that the middle sliding door 18 and outermost sliding door 20 are constructed and arranged to arrive in an overlapping relation to the fixed door panel 16 at the same time. In other words, the sliding movement of the middle sliding door 18 and the outermost sliding door 20 is a parallel movement (i.e., both the sliding panels moving at the same time but at a different speed) rather than a serial movement (i.e., the middle sliding door panel slides after the outermost sliding door panel).

Figure 3:
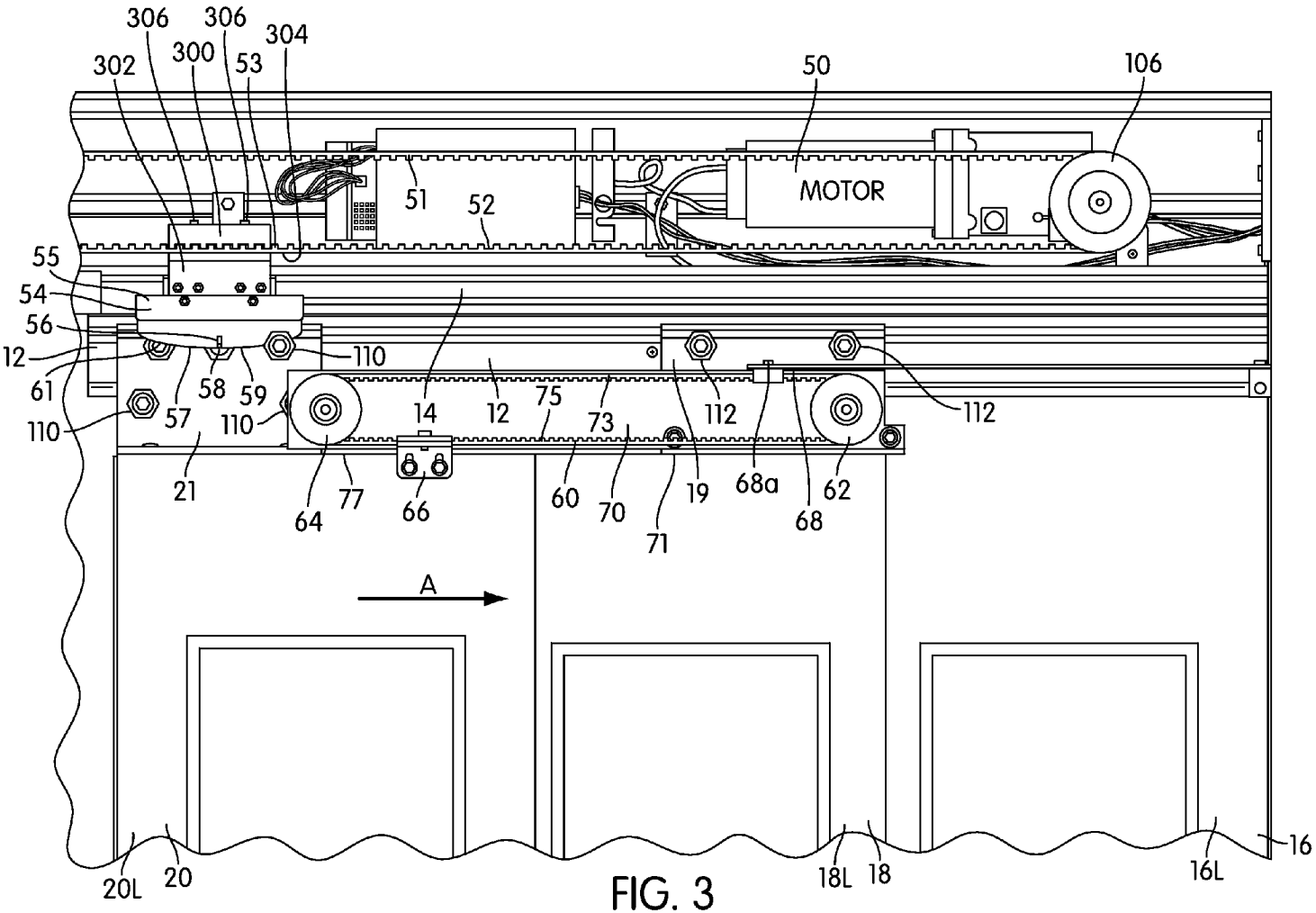
FIG. 3 is a rear view of the door assembly illustrating a door controlling unit (or a drive mechanism) operatively connected to outermost sliding door panels to control the opening and closing movements of the sliding door panels of the door assembly in accordance with an embodiment of the present invention.

In normal operation of the sliding door panels 18 and 20, when a motion sensor (as known in the art) detects an individual approaching the doorway, a door opening signal is generated and input to a controller or processor (not shown), which in turn generates a signal to drive a motor 50 (as shown in FIG. 3). The motor 50 operates to slide the sliding door panels 18L and 20L leftward and the sliding door panels 18R and 20R rightward (when oriented as in FIG. 2) such that the sliding door panels 18L, 20L and 18R, 20R are moved (generally continuously) from the closed position covering the opening 26, through an intermediate position (as shown in FIGS. 1A, 7-10), and then to the open position (i.e., where the sliding door panels 18 and 20 are in a compact, overlapping relationship with each other as shown in FIG. 2A), thereby permitting egress through the opening.

After a predetermined period of time, the controller generates a door closing signal to cause the motor 50 to return the sliding door panels 18 and 20 to the closed position of FIG. 2. The aforementioned sensor for sensing the presence of an individual may optionally be of the type disclosed in U.S. Pat. No. 7,042,492 ("the '492 patent") to Spinelli, entitled "Automatic Door Assembly with Video Imaging Device," which is hereby incorporated by reference in its entirety. The controller may also include the sliding door control functionality disclosed in the '492 patent to control opening and closing sliding movement of the door panels.

The sliding door panels 18 and 20 are generally mounted on sliding panel carriers 19 and 21 (as shown in FIG. 3) respectively. In one embodiment, the sliding panel carriers 19 and 21 are fitted into an upper portion of the sliding door panels 18 and 20 respectively. The sliding panel carriers 19 and 21 are slidably received within or on the track 12 to slidably move the sliding door panels 18 and 20 on the track 12. In one embodiment, the sliding panel carriers 19 and 21 may be mounted in the track 12 on rollers, bearings wheels or other mounting mechanisms known in the art that permit the sliding panel carriers 19 and 21 to slide generally linearly along the track 12.

Figure 7:
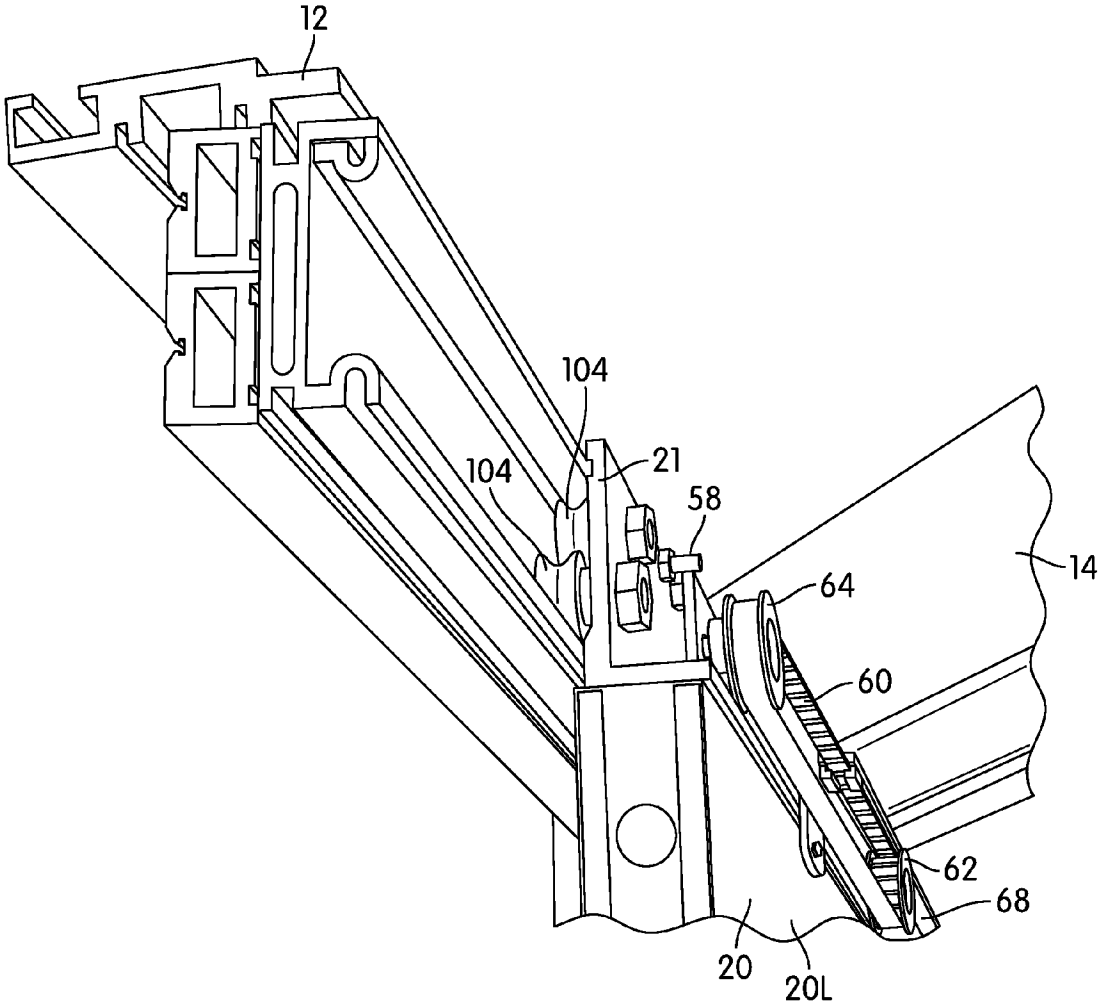
FIGS. 7-9 show track with the fixed door panel and the two sliding door panels mounted thereon, wherein the track is being pivoted away from the normal configuration when the sliding door panels are in different positions (i.e., the open position, or the intermediate position) in accordance with an embodiment of the present invention.
Figure 9:
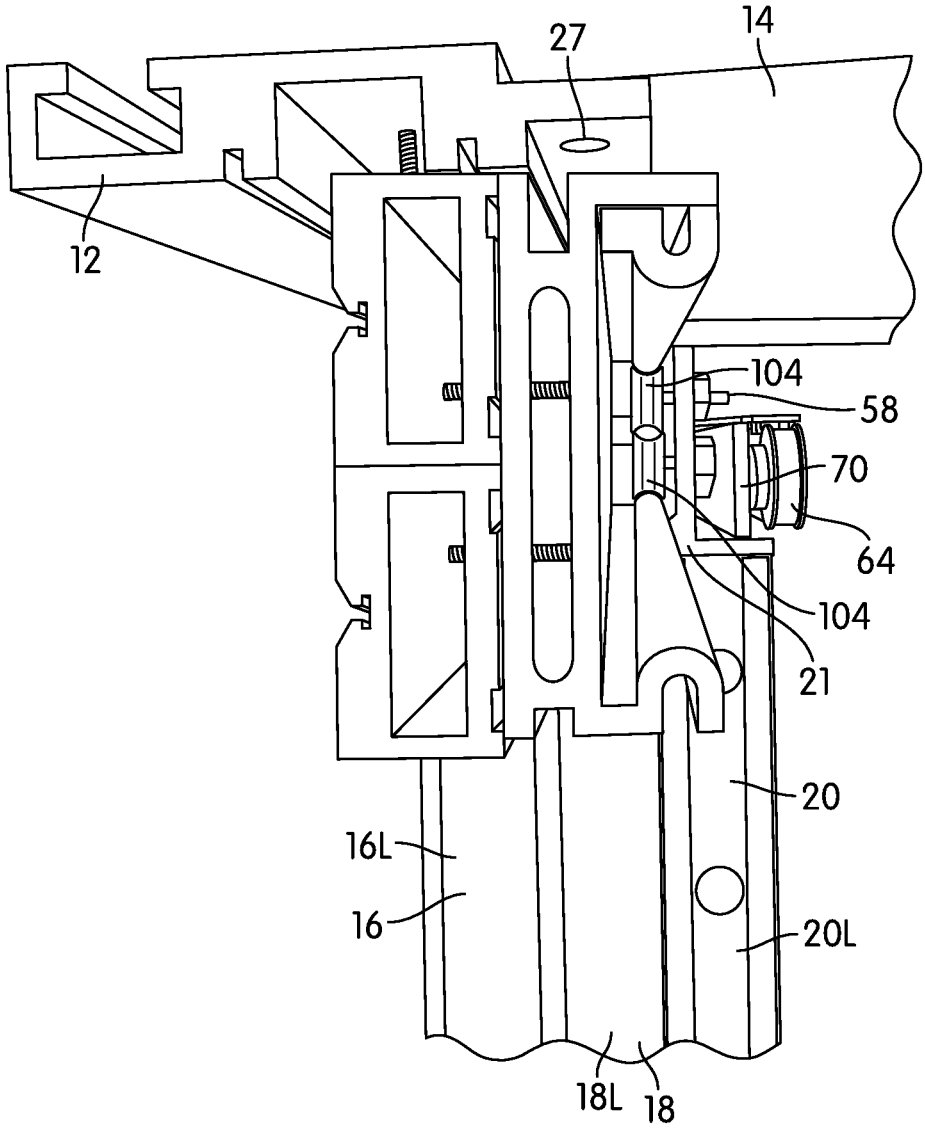

In one embodiment, rollers or bearing wheels 104 (as shown in FIGS. 7 and 9) are constructed and arranged to permit the sliding panel carrier 21 of the sliding door panel 20 to slide generally linearly along the track 12. Similar rollers or bearing wheels (not shown) are constructed and arranged to permit the sliding panel carrier 19 of the sliding door panel 18 to slide generally linearly along the track 12.

Figure 3A:
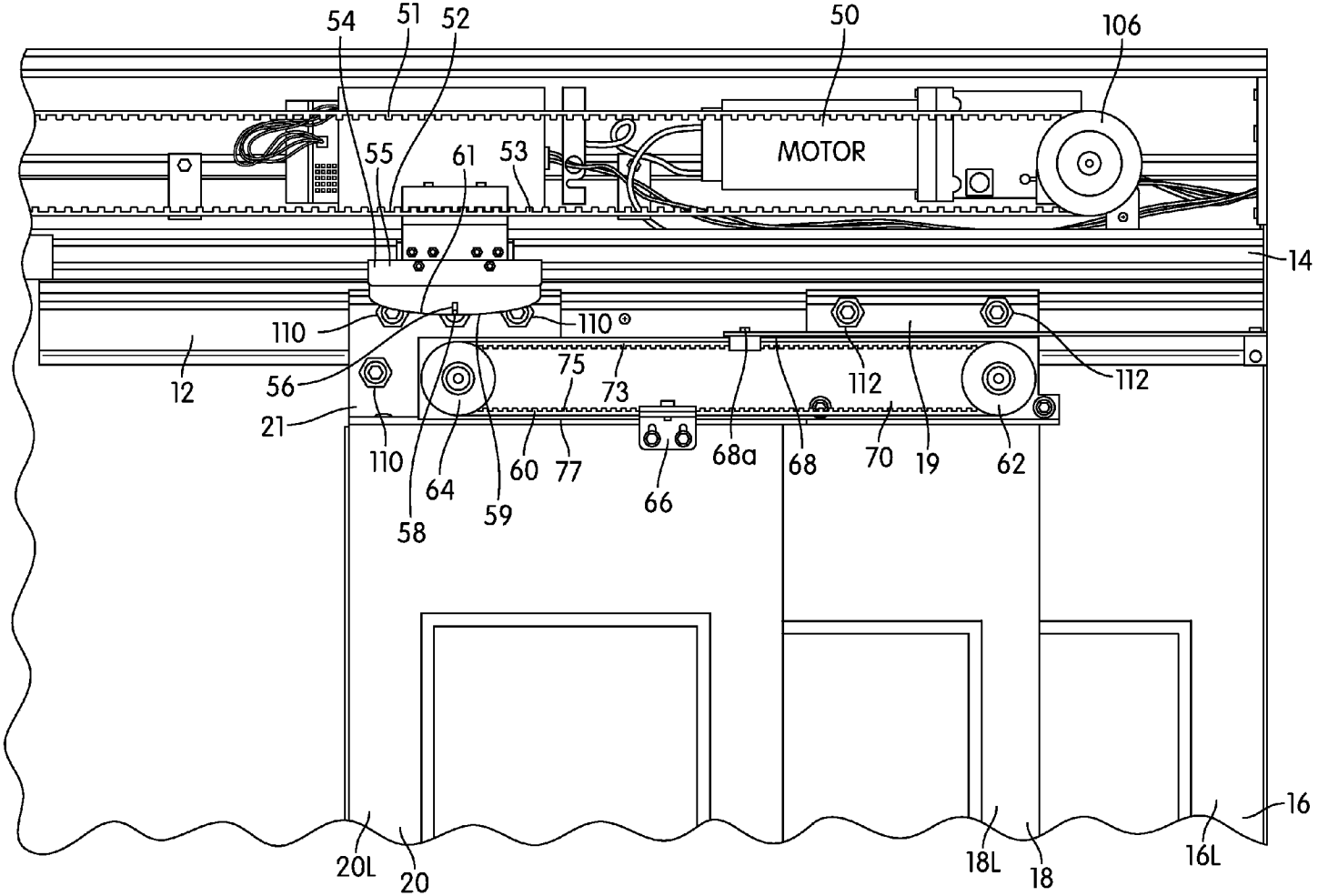
FIG. 3A is another rear view of the door assembly illustrating the door controlling unit (or a drive mechanism) operatively connected to outermost sliding door panels to control the opening and closing movements of the sliding door panels of the door assembly, where the outer most sliding door panel is partially open, in accordance with an embodiment of the present invention.
Figure 4:
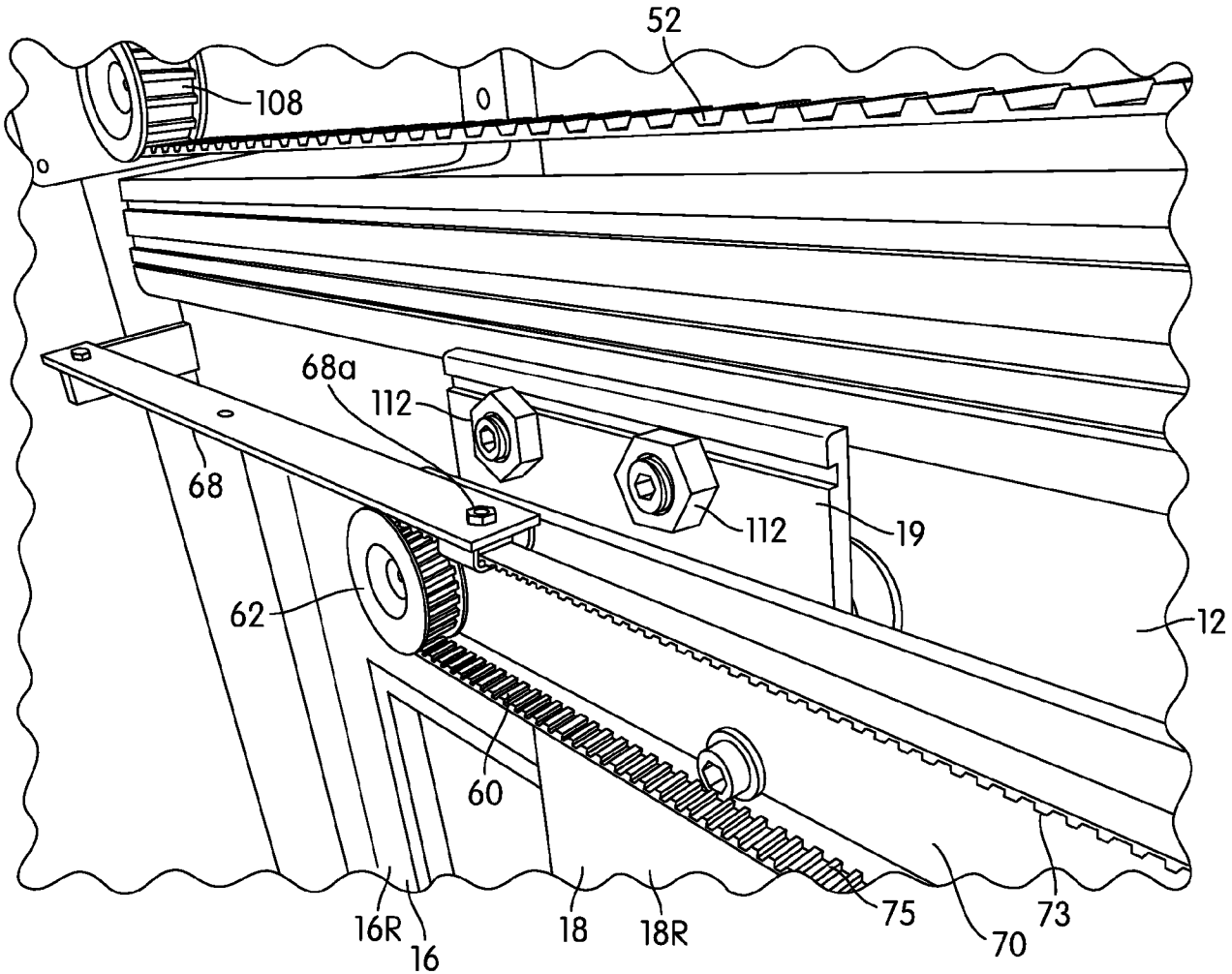
FIG. 4 is a rear, perspective view of the door assembly illustrating a drive unit of middle sliding door panel, wherein, a portion of the drive unit is fixedly connected to the fixed door panel of the door assembly in accordance with an embodiment of the present invention.

In one embodiment, as shown in FIGS. 3, 3A and 4, the rollers or bearing wheels 104 of the sliding door panel 20 are mounted on the sliding panel carrier 21 by using pivot assemblies 110 and the rollers or bearing wheels (not shown) of the sliding door panel 18 are mounted on the sliding panel carrier 19 by using pivot assemblies 112.

The door assembly 10 may include a frame assembly that may be of any construction and need not be explained herein in great detail. The frame assembly may generally include the track header 14 extending across the top edge thereof and upper guide rail, track 12 or the like for guiding the sliding panel carriers 19 and 21 for rectilinear movement that enables movement of the sliding panels 18, 20 between their opened and closed positions. The sliding panel carriers 19 and 21 may be sliding or rolling mounted in the or on track 12 to facilitate such movement. In one embodiment, as explained in detail below, the track header 14 generally houses the components that move the sliding panels 18, 20 between the open and closed positions thereof. In one embodiment, the frame assembly may also include generally vertically extending members extending between the floor and the track header 14.

In one embodiment, the sliding door panels 18 and 20 and their respective sliding panel carriers 19 and 21 are maintained in planar alignment with the doorway. The sliding panel carriers 19 and 21 may be linearly driven along the track 12 on the track header 14 by a drive mechanism such as an electromagnetic, pneumatic, hydraulic or any other suitable motor or other type of drive mechanism. In illustrated embodiment, as shown in FIG. 3A, the drive mechanism may generally comprise the electromechanical motor 50 mounted in or on the track header 14 such that the motor 50 cooperates with a cable, belt, chain, screw-drive or other such mechanism to slide the sliding door panels 18 and 20 along the track 12 in a direction of sliding.

In the illustrated embodiment, as shown in FIGS. 3 and 3A, the outermost sliding panel 20 is connected to a section of a continuous toothed belt 52. The continuous toothed belt 52 is looped about an idler pulley 108 (as shown in FIG. 4) and a drive pulley 106 (as shown in FIG. 3A). In one embodiment, the continuous toothed belt 52, the idler pulley 108, and the drive pulley 106 may be together considered as a belt system. The idler pulley 108 (as shown in FIG. 4) is remotely rotated by the drive pulley 106, and the drive pulley 106 is generally rotationally driven by the motor 50. The drive pulley is constructed and arranged to transmit force to the idler pulley 108 (as shown in FIG. 4) through the belt 52. In one embodiment, the belt 52 may include a set of teeth which engage corresponding teeth sets extending from the pulleys. The motor 50 may directly the drive pulley 106 or may do so through, for example, a gearbox. The drive pulley 106 is rotatably driven by the motor 50 for linearly moving sliding door panel 20 in a direction of sliding.

FIG. 4 shows two right side sliding door panels 18R and 20R of the door assembly 10, while FIGS. 3, 3A and 7-9 show the left side fixed door panel 16L, and the left side sliding door panels 18L and 20L of the door assembly 10.

In one embodiment, in a dual break-out system (i.e., a door system having two sets of three door panels where door panels 16L, 18L, 20L on the left side and door panels 16R, 18R, 20R on the right side), one of the outermost sliding door panels 20L or 20R is connected to an upper section 51 of the continuous toothed belt 52 and the other of the outermost sliding door panels door panel 20L or 20R is connected to a lower section 53 of the toothed belt 52. In such embodiment, the drive pulley 106 is rotatably driven by the motor 50 for linearly moving the left and right sliding door panels (20L and 20R) in cooperating opposite directions. In FIGS. 3 and 3A, only the left side door panels are shown, and it can be seen that the outermost sliding door panel 20L is connected to the lower section 53 of the toothed belt 52 via connector 54 and the panel carrier 21.

In another embodiment (not shown), in a single break-out system (i.e., a door system having only one set of three door panels 16, 18, 20 instead of two sets of three door panels where each set located on each side of the door assembly), the outermost sliding door panel (i.e., the fast panel) is connected to either the upper section 51 or the lower section 53 of the continuous toothed belt 52, depending on the desired opening direction.

As noted above, as shown in FIGS. 3 and 3A, the outermost sliding door panel 20 is securely connected to the lower portion 53 of the continuous toothed belt 52 by the connector (or connecting member) 54 and the sliding door panel carrier 21. Specifically, the connecting member 54 may include a notch, a groove, or an opening 56 that is constructed and arranged to engage with an engaging member 58 (e.g., a pin member) disposed on the sliding panel carrier 21 of the outermost sliding panel 20. In one embodiment, the connecting member 54 is spring loaded into position so that the notch, groove, or opening 56 located thereon engages with the engaging member 58 disposed on the sliding panel carrier 21 of the outermost sliding panel 20 to securely connect the outermost sliding door panel 20 to the section of the continuous toothed belt 52.

In the illustrated embodiment, as shown in FIG. 3, the connecting member 54 includes a first belt connecting portion 300 and a second belt connecting portion 302. In one embodiment, the first belt connecting portion 300 may include a set of teeth which engage corresponding teeth sets extending from the continuous toothed belt 52. In one embodiment, at least a portion 308 of the second belt connecting portion 302 (e.g., is in the form of a L-shaped bracket member) is constructed and arranged to engage with a surface 304 of the continuous toothed belt 52. In one embodiment, the first belt connecting portion 300 and the second belt connecting portion 302 are clamped to the continuous toothed belt 52 using fastening means, for example, bolts 306. In one embodiment, the fastening means 306, and the teeth of the first belt connecting portion 300, are constructed and arranged to clamp the connecting member 54 to the continuous toothed belt 52, thus, enabling the movement of the connecting member 54 along with the continuous toothed belt 52. Other structures and forms of connection between the connector 54 and the toothed belt 52 can be used, as will be appreciated by those skilled in the art reading this specification.

In the illustrated embodiment, as shown in FIG. 3, the connecting member 54 is used to securely connect the outermost sliding door panel 20R (i.e., right side sliding door panel) to the lower section 53 of the continuous toothed belt 52 to facilitate linear movement of the outermost sliding door panel 20R in a direction of sliding. However, it is contemplated that a connecting member similar to the one described above may be used to securely connect the outermost sliding door panel 20L (i.e., left side sliding door panel) to the upper section of the continuous toothed belt 52 to facilitate linear movement of the outermost sliding door panel 20R in a direction of sliding.

In one embodiment, the connecting member 54 includes an upper rigid portion 55 and a lower resilient portion 57. The engaging member 58 disposed on the sliding panel carrier 21 of the outermost sliding panel 20 is constructed and arranged to slide along a lower edge 59 of a convex lower surface 61 of the lower resilient portion 57 until the engaging member 58 aligns with the notch 56 of the lower resilient portion 57, and then the engaging member 58 engages (e.g., snaps into) with the notch 56. In one embodiment, the lower resilient portion 57 may be made of a plastic material. An internal spring (not shown) may be constructed and arranged to bias the lower resilient portion 57 down relative to the upper rigid portion 55, and limited relative vertical movement of the lower resilient portion 57 relative to rigid portion 55 is permitted. While one form of releasable connection (i.e., the connecting member 54 and the sliding panel carrier 21) is illustrated in the figures, other structures for releasably connecting the outer sliding door panel 20L to the continuous toothed belt 52 may be provided, as will be appreciated by those skilled in the art reading this specification.

The drive mechanism described above is just an example and it is contemplated that any power-operated door controlling unit or drive mechanism may be operatively connected to the sliding panel 20 to control the opening and closing movements of the sliding panel 20.

For the purposes of this invention, the term "track header" as used herein should be construed broadly to refer to any frame member that is fixed to the door opening 26. In the illustrated embodiment, the motor 50, the drive pulley 106, the connecting member 54, the idler pulley 108, and the continuous toothed belt 52 are mounted on the track header 14. However, in another embodiment, some or all of the drive mechanism components may be mounted on a structure that is fixed relative to the track 12 (or considered part of track 12), so that these components pivot with the track during a breakaway condition.

In one embodiment, as shown in FIGS. 3 and 4, the middle sliding door panel 18 includes an elongated support member 70 fixedly secured to an upper portion 71 of the door panel 18. As shown in FIG. 3, when the door assembly is in the closed position, the support member 70 may partially overlap door panel 20. A toothed belt 60 is carried by the support member 70. The belt 60 may be trained about a first pulley 62 and a second pulley 64 that are rotatably mounted on the support member 70. In one embodiment, the toothed belt 60 along with the first pulley 62 and the second pulley 64 is attached to an upper portion of the middle sliding door panel 18 by the support member 70. In another embodiment, the toothed belt 60 along with the first pulley 62 and the second pulley 64 is attached to the sliding door panel carrier 19 of the middle sliding door panel 18 by the support, member 70. In one embodiment, an upper section 73 of the continuous toothed belt 60 is connected to (or fixed relative to) the fixed door panel 16 or to the track 12, and a lower section 75 of toothed belt 60 is connected to an upper portion 77 of the outermost sliding door panel 20. In one embodiment, the lower section 75 of the toothed belt 60 is connected to the upper portion 77 of the outermost sliding door panels door panel 20 by a first connecting portion 66. In one embodiment, the first connecting portion 66 is constructed and arranged to transfer the movement of the outermost sliding door panel 20 to the middle sliding door panel 18. In one embodiment, as shown in FIGS. 3 and 4, the upper section 73 of the continuous toothed belt 60 is fixedly connected relative to the fixed door panel 16 at connection 68*a* by a second connecting portion 68.

When the outermost sliding door panel 20 is driven via the connecting member 54 and the belt 52 from the closed position to the open position, the first connecting portion 66 that engages with the lower section of the belt 60 and is connected to the door panel 20 moves the lower portion of the belt 60 in the direction of an arrow A (See FIG. 3). Since the belt 60 along with the first and the second pulleys 62 and 64 and the support member 70 is connected to the middle sliding door panel 18, the belt 60 transmits the movement from the outermost sliding door panel 20 to the middle sliding door panel 18 via the belt 60. Specifically, referring to FIGS. 3 and 3A, the driving of the outermost door panel 20 towards the open position causes the first connection portion 66 of the outermost door panel 20 with the belt 60 to get closer to the fixed connection 68*a* (of the second connection portion 68) between the belt 60 and the fixed door panel 16. This action pushes the second pulley 64 towards the right in FIGS. 3 and 3A. This forced movement of the second pulley 64 causes the entire support member 70 and the middle door panel 18 (which is fixed relative to support member 70 and the pulleys 62 and 64) to be driven towards the right (towards the fixed door panel 16). Also, as noted above, the belt 60, and the first and second pulleys 62 and 64 are constructed and arranged so that the outermost sliding door 20 moves twice as fast as the middle sliding door 18 so that the middle sliding door 18 and outermost sliding door 20 are constructed and arranged to arrive in an overlapping relation to the fixed door panel 16 at the same time.

The pivot mechanism 200 (as shown in FIG. 10) is constructed and arranged to pivot the track 12 with fixed door panel 16 and the two sliding door panels 18 and 20 mounted thereon about a pivot axis from (1) a normal configuration wherein the track 12 is positioned such that the door panels 18 and 20 will cover the opening 26 when in the closed position, to (2) a breakaway configuration wherein the track 12 is pivoted away from the normal configuration. The track 12, when positioned in the breakaway configuration, is constructed and arranged to uncover the opening 26 that the sliding door panels 18 and 20 and the fixed panel 16 cover when the door assembly 10 is installed to thereby enable access therethrough. The two sliding door panels 18 and 20 constructed and arranged to generally rectilinearly move between the open position and the closed position when the door assembly 10 is installed and when the track 12 is positioned in the normal configuration.

FIG. 10 shows the left side fixed door panel 16L, and the left side sliding door panels 18L and 20L of the door assembly 10. In one embodiment, as shown in FIG. 10, the pivot mechanism 200 may include a pivot pin or rod 202 that is generally vertically extending upwardly from the floor 210. In one embodiment, the pin 202 is constructed and arranged to be received in hole 206 disposed in the bottom portion 208 of the fixed door panel 16L. As also shown in FIG. 10, the pivot mechanism 200 may also include a pivot pin or rod 204 that is generally vertically extending upwardly from the track 12 or upper portion of the fixed door panel 16L. In one embodiment; the pin 204 is constructed and arranged to be received in hole 212 disposed in the track header 14 or the frame assembly of the door assembly. It should be appreciated that the track 12 and all three door panels illustrated (16L, 18L, 20L) are pivoted about a single pivot axis, which in this embodiment passes through the rods or pins 202 or 204 (although other hinge types can be provided to permit single pivot axis movement, as will be appreciated by those skilled in the art reading this specification). A similar pivot arrangement can be provided for the right door panels 16R, 18R, 20R in a dual-breakout system.

In an alternate embodiment, the pivot mechanism 200 may include pivot pins or rods that are generally vertically extending downwardly from the bottom portion of the fixed door panels that are constructed and arranged to be received in holes disposed in the floor. In such an embodiment, the pivot mechanism may also include pivot pins or rods that are generally vertically extending downwardly from the track header 14 or the frame assembly of the door assembly that are constructed and arranged to be received in holes disposed the track 12 or upper portion of the fixed door panels.

It should be appreciated that other pivot or hinge arrangements are possible in accordance with this application that allow all the door panels to pivot together about a single pivot axis.

As shown in FIGS. 5 and 6, the lock arrangement 24 is constructed and arranged to releasably lock the track 12 with respect to the track header 14 to prevent pivotal movement of the track 12 away from the normal configuration. The lock arrangement 24 is configured to enable the track 12 to be unlocked with respect to the track header 14 and enable the track 12 with fixed door panel 16 and the two sliding door panels 18 and 20 mounted thereon to be pivoted away from the normal configuration to the breakaway configuration.

The lock arrangement 24 may be of numerous different types of configurations as will be appreciated by those skilled in the art when considering this disclosure. For example, in one embodiment, lock arrangement 24 includes a movable member 25 disposed on the track header 14 constructed and arranged to engage with a movable member receiving opening 27 disposed on the track 12 to releasably lock the track 12 with respect to the track header 14 and to prevent pivotal movement of the track 12 away from the normal configuration. In another embodiment, the lock arrangement may include a movable member disposed on the track 12 constructed and arranged to engage with a movable member receiving opening disposed on the track header 14 to releasably lock the track 12 with respect to the track header 14 and to prevent pivotal movement of the track 12 away from the normal configuration.

In one embodiment, the movable member 25 of the lock arrangement 24 is constructed and arranged to be movable between a locking position and an unlocking position. In one embodiment, the movable member 25 is constructed and arranged to move in a linear motion (i.e., up and down). The movement of the movable member 25 from the locking position to the unlocking position unlocks the track 12 with respect to the track header 14 and to enable the track 12 with the fixed door panel 16 and the two sliding door panels 18 and 20 mounted thereon to be pivoted away from the normal configuration to the breakaway configuration.

The lock arrangement 24 is spring biased into the locking position to releasably lock the track 12 with respect to the track header 14 and to prevent unintended pivotal movement of the track 12 away from the normal configuration. In one embodiment, the lock arrangement 24 includes a spring 29. In one embodiment, the spring 29 may include a coil spring or a compression spring. The movable member 25 is configured to be received in the movable member receiving opening 27 by the spring 29. The spring 29 forces/biases movable member into its locking position. Thus, the spring 29 is constructed and arranged to releasably lock the track 12 with respect to the track header 14 and to prevent pivotal movement of the track 12 away from the normal configuration. The spring bias of the spring 29 pushes the movable member 25 downwardly, forcing the movable member 25 to be received in the movable member receiving opening 27 disposed on the track 12, when the track 12 is in the normal configuration.

In one embodiment, the spring 29 and the movable member 25 are disposed in a recess 31 of the track header 14. In the illustrated embodiment, as shown in FIG. 6, the movable member 25 of the track header 14 generally may include a ball-shaped configuration, a circular shaped configuration, a cylindrical shaped configuration or a spherical shaped configuration as non-limiting examples. The movable member receiving opening 27 is constructed and arranged to lockingly receive the movable member 25 therein, when the lock arrangement 24 is in the locking position. The movable member receiving opening 27 of the track 12 generally may include a circular shaped configuration as a non-limiting example.

In order to unlock the track 12 from the track header 14, an individual may apply sufficient outward force on the fixed door panel 16 and/or the sliding door panels 18 and 20 of the door assembly 10 to overcome the locking force of the releasable lock 24. Specifically, the outward breakout force applied to the door panel(s) moves the movable member 25 upwards from the locking position to the unlocking position. When the movable member 25 is moved from the locking position to the unlocking position, the movable member 25 is constructed and arranged to compress the spring 29. In other words, a portion of the movable member 25, which engages with the spring 29 at one end thereof, is constructed and arranged to compress the spring 29 from its relaxed configuration to a compressed (or tensioned) configuration. Also, when the movable member 25 is moved from the locking position to the unlocking position (i.e., against the action of spring 29), the movable member 25 moves up and away from the movable member receiving opening 27 disposed on the track 12. Thus, the movable member 25 is able to move upwardly for disengagement from the movable member receiving opening 27. This upwardly movement of the movable member 25 unlocks the track 12 (i.e., with the fixed door panel 16 and the two sliding door panels 18 and 20) with respect to the track header 14, and permits the pivotal movement of the track 12.

The spring 29 is constructed and arranged to bias the movable member 25 from the unlocking position to the locking position so that the movable member 25 is engaged with the movable member receiving opening 27 of the track 12, when the track 12 is returned to its normal configuration.

In another embodiment, an electronic arrangement (i.e., where a controller based on the control signals received operates the lock arrangement 24) may be used to lock or unlock the track 12 from the track header 14. In such an embodiment, the electronic arrangement may include a battery back-up to power the electronic arrangement, for example, in case of a power failure.

In one embodiment, control signals may be generated within the door assembly, whereby the state of these control signals influence operation of the lock arrangement 24. For example, a door release mechanism (e.g., a push bar) may be provided on the door panels that, when operated, closes or opens a switch (e.g., a micro-switch assembly), or otherwise sends a signal to the controller, thereby indicating a request to disengage or unlock the lock arrangement 24 so that the track 12 (i.e., with the sliding door panels 18 and 20 and the fixed door panel 16 mounted thereon) may be pivoted open. In one embodiment, a push bar may contain a micro-switch assembly that is actuated when an individual forces the push bar inwardly a predetermined distance against an internal spring that biases the push bar outwardly.

In another embodiment, the door assembly 10 does not include the door release mechanism (e.g., a push bar). In such embodiment, the door assembly 10 may include other mechanisms that are configured to send control signals to the controller indicating a request to lock or unlock the lock arrangement 24 as explained below. In such an embodiment, the door assembly 10 may include, for example, ball and spring arrangement 24 (as explained with reference to FIGS. 5 and 6) for releasably locking door to and from pivotal movement.

In one embodiment, a key lock or keypad that may be used to lock and unlock the door panels and to enable and disable the lock arrangement 24. In such an embodiment, the key lock or keypad is configured to send control signals to the controller indicating a request to disengage or unlock, the lock arrangement 24 so that track 12 (i.e., with the sliding door panels 18 and 20 and the fixed door panel 16 mounted thereon) may be pivoted open.

In another embodiment, a sensor or switch mounted on, for example track header 14 detects that the door panels itself have been pushed, which will generate a control signal to controller. Sensors or switches may detect displacement of the sliding door panels relative to the header or may detect application of a pivotal opening force. In one embodiment, application of pivotal opening forces may be detected by any other known means including strain gauges, changes in electrical current applied to an electromagnetic shear lock, and so on.

In one embodiment, the controller is configured to monitor control signals and to selectively enable and disable lock arrangement 24. The controller may be located in the door panel, in the door panel carrier, in the track header, adjacent to the track header or in a location remote from the door panels. A power supply may be collocated with the controller within the door assembly. For example, the power supply may be mounted in the track header and may be configured to provide power supply to the controller. The controller may process one or more signals to determine operational state of lock arrangement 24. In one embodiment, the controller includes a processor, storage, input/output devices and executes software and/or firmware configured to monitor control signals. As explained above, the control signals may be provided by sensors, switches, actuators and other externally provided controls. The controller may determine when the lock arrangement 24 should be engaged or disengaged based on the state of monitored control signals.

In one embodiment, the controller is configured to determine the status and current configuration of the sliding door system by monitoring electrical connections between the track header and the track. Based on determined status and configuration, the controller may activate and deactivate the lock arrangement 24 and may transmit alarms and monitoring signals to a centralized control system. In one embodiment, after the door panels have been pivotally opened, the controller may reactivate the lock arrangement 24 upon detecting that the door panels have been returned to its normal configuration.

It is contemplated that various methods may be employed to communicate signals to the controller. In one embodiment, switches of various kinds may be used, including push-button switches, key-activated switches, motion detector switches, RFID readers, keypads, and so on. In another embodiment, the controller may be adapted to communicate with a remote control center. The controller may be adapted by providing the controller with a communications interface for accessing wired and wireless communications interfaces including interfaces for serial data links (including modems), wired and wireless Ethernet networks, WiFi, InfraRed, Bluetooth and cellular telephone networks.

Thus, as explained above, the lock arrangement 24 of the door assembly 10 may be operated manually, electronically, or a combination thereof.

In one embodiment, a breakaway override feature may be implemented to disable the breakaway feature of the door assembly 10. In other words, it may be desirable to selectively disable the breakaway feature so that lock arrangement 24 may remain locked or enabled even when a) a manual force is applied on the door assembly 10 or b) the door release mechanism is actuated so that the door assembly 10 remains pivotally locked. Such breakaway override feature may be implemented to prevent the pivoting of the door assembly 10 as needed or desired, for example, at night when the facilities (e.g., commercial buildings) are closed for normal operation, or if the facilities (e.g., commercial buildings) may remain be vacant for an extended period of time.

In one embodiment, the breakaway override feature may be implemented using a deadbolt lock. Such deadbolt lock may be used to mechanically lock the sliding door panels 18 and 20 to more securely and supplementally lock the sliding door panels 18 and 20.

Such deadbolt lock arrangement may include a thumb-turn lock arrangement (not shown) mounted on the inside surface of the door assembly 10 and a key cylinder lock arrangement (not shown) disposed on the outside or exterior surface of the door assembly 10. As know in the art, a key cam with follower and a deadbolt are mounted within an edge of the door assembly. The key cam with follower and the deadbolt are connected to the key cylinder lock arrangement and the thumb-turn lock arrangement. Also as known in the art, rotation of the key cam causes the cam follower to rotate into engagement with the deadbolt to actuate the deadbolt between a locked position and an unlocked position. The key cam is rotated either by actuating the key cylinder lock arrangement (i.e., using a key) or the thumb turn lock arrangement (i.e., using a thumb turn knob). The key cylinder lock arrangement and/or the thumb-turn lock arrangement are constructed and arranged to prevent unauthorized opening of the door assembly 10.

Alternatively, the breakaway override feature may be implemented using the electronic arrangement (i.e., where a controller based on the control signals received operates the lock arrangement 24). In such an embodiment, the electronic arrangement may include a battery back-up to power the electronic arrangement, for example, in case of a power failure.

In one embodiment, when a detector or sensor for detecting an individual approaching the doorway is disabled by the controller to prevent the door panels 18 and 20 from sliding to its open position, the drive mechanism or motor is configured so that it may not be back driven to thus prevent the door panels 18 and 20 from being manually slid to the open position. In another embodiment, a mechanical solenoid in the track header 14 prevents the door panels 18 and 20 from being manually slid open. In either case, however, such mechanism would not prevent or inhibit the pivotal breakaway feature, at least in most embodiments.

Figure 8:
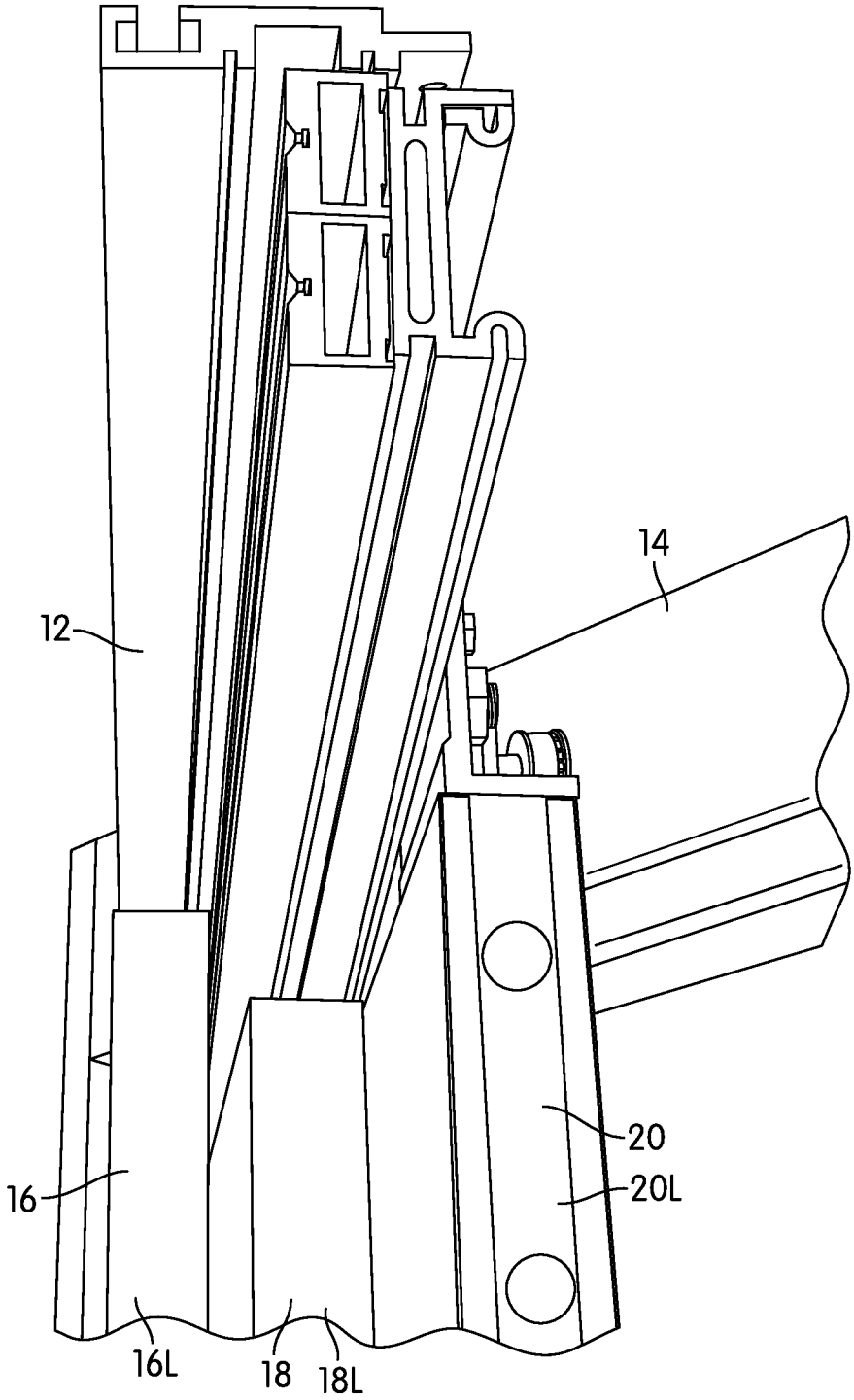

In one embodiment, the track 12 with the fixed door panel 16 and the two sliding door panels 18 and 20 mounted thereon is pivoted away from the normal configuration when the sliding door panels 18 and 20 are in the closed position (as shown in FIG. 2), the open position (i.e., where the sliding door panels 18 and 20 are in a compact, overlapping relationship with each other as shown in FIG. 2A), or an intermediate position (as shown in FIG. 7-9) therebetween.

In one embodiment, a method for controlling a pivotal movement of a door assembly is provided. The method includes maintaining a track with a fixed door panel and at least two sliding door panels mounted thereon in a pivotally locked condition with respect to a track header, and pivotably moving the track with the fixed door panel and the at least two sliding door panels mounted thereon away from the pivotally locked condition to the breakaway condition under an application of a force. The track, when in the pivotally locked condition, is positioned such that the sliding door panels are configured to extend across the track to cover an opening formed through a wall to which the door assembly is installed.

It should be appreciated that while the details provided above are described in relation to a door assembly having three door panels on each side of the door assembly, the present invention applies equally to a door assembly having a three door panels (i.e., the door assembly with only one set of three door panels instead of two sets of three door panels where each set located on each side of the door assembly).

It is contemplated that the systems and methods described apply equally to door assemblies with one fixed door panel and one sliding door panel (instead of two sliding door panels). In such door assemblies, the left and right sliding door panels are disposed in an adjacent aligned relationship when in a closed position covering an enlarged door opening as known in the art. Upon a sensor detecting an individual approaching the doorway, the left and right door panels move away from one another in opposite linear directions to expose the opening therebetween. The left and right sliding door panels would then return to the closed position after a predetermined period. The track with fixed door panel and the sliding door panel mounted thereon is pivoted away from the normal configuration when the sliding door panel is in the closed position, in the open position, or in an intermediate position therebetween.

In one embodiment, to control the manner in which the track 12 with the sliding door panels 18 and 20 and the fixed door panel 16 mounted thereon will swing once breakout/breakaway has begun, damping devices may be connected at one end to the track 12 and at the other end to the track header 14 that houses the door controlling unit or the drive mechanism. In one embodiment, these damping devices may include a gas or fluid filled damping devices. These devices are designed to provide controlled resistance to the swinging breakout movement of the track 12. Specifically, these devices prevent the track 12 from being thrown open in an uncontrolled manner by persons seeking exit through the door assembly and also prevent high winds from acting on the panel and also throwing it open in a uncontrolled manner.

In one embodiment, sensors are mounted at the leading and trailing edges of the sliding door panels to sense whether an obstacle or traffic has cleared. These sensors may include infra-red sensor, for example, mounted at the leading and trailing edges of the sliding door panels to ensure that the sliding doors do not inadvertently close. These sensors are configured to sense the presence of traffic in the doorway and to prevent the sliding doors from closing until the traffic has cleared the entranceway.

Although the invention has been described in detail for the purpose of illustration, it is to be understood that such detail is solely for that purpose and that the invention is not limited to the disclosed embodiments, but, on the contrary, is intended to cover modifications and equivalent arrangements that are within the spirit and scope of the appended claims. In addition, it is to be understood that the present invention contemplates that, to the extent possible, one or more features of any embodiment can be combined with one or more features of any other embodiment.

What is claimed is:

1. A door assembly comprising:

a fixed track header constructed and arranged to be mounted in fixed relation with respect to an opening formed through a wall to which the door assembly is installed;

a track;

a fixed door panel constructed and arranged to be fixed relative to the track, and at least two sliding door panels constructed and arranged to be slidably movable on the track, wherein the at least two sliding door panels are constructed and arranged to be slidably movable on the track between (1) a closed position wherein the at least two sliding door panels are extended across the track, and (2) an open position wherein the at least two sliding door panels are constructed and arranged to be in a compact, overlapping relationship with each other and the fixed door panel;

a drive mechanism constructed and arranged to drive the at least two sliding door panels between the closed position and the open position, wherein the drive mechanism is mounted on the fixed track header;

a pivot mechanism constructed and arranged to enable pivotal movement of the track with the fixed door panel and the at least two sliding door panels mounted thereon, about a pivot axis from (1) a normal configuration wherein the track is positioned such that the door panels will cover the opening when in the closed position, to (2) a breakaway configuration wherein the track is pivoted away from the normal configuration; and a lock arrangement constructed and arranged to releasably lock the track with respect to the fixed track header to prevent pivotal movement of the track away from the normal configuration, the lock arrangement configured to enable the track to be unlocked with respect to the fixed track header and enable the track with fixed door panel and the at least two sliding door panels mounted thereon to be pivoted away from the normal configuration to the breakaway configuration.

2. The door assembly of claim 1, wherein each of the at least two sliding door panel includes at least one sliding panel carrier fitted into an upper portion of the sliding door panel, the sliding panel carrier is slidably received within the track to slidably move the corresponding sliding door panel on the track.

3. The door assembly of claim 1, wherein the track, when positioned in the breakaway configuration, is constructed and arranged to uncover the opening that the at least two sliding door panels and the fixed panel cover when the door assembly is installed to thereby enable access therethrough.

4. The door assembly of claim 1, wherein the at least two sliding door panels constructed and arranged to generally rectilinearly move between the open position and the closed position when the door assembly is installed and when the track is positioned in the normal configuration.

5. The door assembly of claim 1, wherein the lock arrangement comprises an engageable member disposed on the track header constructed and arranged to engage with an engageable member receiving opening disposed on the track to releasably lock the track with respect to the track header and to prevent pivotal movement of the track away from the normal configuration.

6. The door assembly of claim 1, wherein the engageable member is spring biased into a locking position to releasably lock the track with respect to the track header and to prevent pivotal movement of the track away from the normal configuration.

7. The door assembly of claim 1, wherein the at least two sliding door panels, when in the open position, is constructed and arranged to permit access through the opening when the door assembly is installed.

8. The door assembly of claim 1, wherein the at least two sliding door panels, when in the closed position, is constructed and arranged to prevent access through the opening when the door assembly is installed.

9. The door assembly of claim 1, wherein the lock arrangement is configured to enable the track to be unlocked with respect to the track header and enable the track with fixed door panel and the at least two sliding door panels mounted thereon to be pivoted away from the normal configuration to the breakaway configuration under an application of a manual force.

10. The door assembly of claim 1, the at least two sliding door panels comprises a middle sliding door panel positioned adjacent to the fixed door panel, and an outermost sliding door panel positioned adjacent to the middle sliding door panel, the outermost sliding door panel is constructed and arranged to move faster than the middle sliding door panel.

11. The door assembly of claim 10, wherein the drive mechanism includes a motor, a belt system, and a connecting member, wherein the connecting member is constructed and arranged to securely connect one of the at least two sliding door panels to the belt system to facilitate linear movement of the at least two sliding door panel in a direction of sliding.

12. The door assembly of claim 10, further comprising a second track, a second fixed door panel constructed and arranged to be fixed relative to the second track, and at least two second sliding door panels constructed and arranged to be slidably movable on the second track,

13. The door assembly of claim 12, wherein the at least two second sliding door panels comprises a second middle sliding door panel positioned adjacent to the second fixed door panel, and an second outermost sliding door panel positioned adjacent to the second middle sliding door panel.

14. The door assembly of claim 13, wherein the outermost sliding door panel and the second outermost sliding door panel are connected to the drive mechanism so as to facilitate linear movement of the outermost sliding door panel and the second outermost sliding door panel in cooperating opposite directions.

15. The door assembly of claim 1, wherein the track, when positioned in the breakaway configuration, is constructed and arranged to uncover the opening that the at least two sliding door panels and the fixed door panel when the door assembly is installed to thereby enable access therethrough.

16. The door assembly of claim 1, wherein the at least two sliding door panels, when positioned in the breakaway configuration, are decoupled from the drive mechanism.

17. A door assembly comprising:

a fixed track header constructed and arranged to be mounted in fixed relation with respect to an opening formed through a wall to which the door assembly is installed;

a track;

a fixed door panel constructed and arranged to be fixed relative to the track, and at least two sliding door panels constructed and arranged to be slidably movable on the track, wherein the at least two sliding door panels are constructed and arranged to be slidably movable on the track between (1) a closed position wherein the at least two sliding door panels are extended across the track, and (2) an open position wherein the at least two sliding door panels are constructed and arranged to be in a compact, overlapping relationship with each other and the fixed door panel;

a drive mechanism constructed and arranged to drive the at least two sliding door panels between the closed position and the open position, wherein the drive mechanism is mounted on the fixed track header; and a pivot mechanism constructed and arranged to enable pivotal movement of the track with fixed door panel and the at least two sliding door panels mounted thereon about a pivot axis from (1) a normal configuration wherein the track is positioned such that the door panels will cover the opening when in the closed position, to (2) a breakaway configuration wherein the track is pivoted away from the normal configuration;

wherein the track with fixed door panel and the at least two sliding door panels mounted thereon can be pivoted away from the normal configuration when the at least two sliding door panels are in the closed position, in the open position, or in an intermediate position therebetween.

18. The door assembly of claim 17, wherein the track, when positioned in the breakaway configuration, is constructed and arranged to uncover the opening that the at least two sliding door panels and the fixed door panel when the door assembly is installed to thereby enable access therethrough.

19. The door assembly of claim 17, wherein the at least two sliding door panels, when positioned in the breakaway configuration, are decoupled from the drive mechanism.

20. A method for controlling a pivotal movement of the door assembly of claim 1, comprising:

maintaining a track with a fixed door panel and at least two sliding door panels mounted thereon in a pivotally locked condition with respect to a track header, the track when in the pivotally locked condition is positioned such that the sliding door panels are configured to extend across the track to cover an opening formed through a wall to which the door assembly is installed; and pivotably moving the track with the fixed door panel and the at least two sliding door panels mounted thereon away from the pivotally locked condition to the breakaway condition under an application of a force.

* * * * *